US007770605B2

(12) United States Patent
Bamelis et al.

(10) Patent No.: US 7,770,605 B2
(45) Date of Patent: Aug. 10, 2010

(54) FABRIC SUPPORT FOR A WEAVING MACHINE

(75) Inventors: Jean-Marie Bamelis, Ieper (BE); Jozef Peeters, Ieper (BE)

(73) Assignee: Picanol N.V., Ieper (BE)

( * ) Notice: Subject to any disclaimer, the term of this patent is extended or adjusted under 35 U.S.C. 154(b) by 0 days.

(21) Appl. No.: 12/281,337

(22) PCT Filed: Sep. 5, 2007

(86) PCT No.: PCT/EP2007/007716

§ 371 (c)(1),
(2), (4) Date: Mar. 31, 2009

(87) PCT Pub. No.: WO2008/031519

PCT Pub. Date: Mar. 20, 2008

(65) Prior Publication Data

US 2009/0218001 A1 Sep. 3, 2009

(30) Foreign Application Priority Data

Sep. 13, 2006 (BE) ..... 2006/0465

(51) Int. Cl.
*D03J 1/22* (2006.01)
*D03C 1/00* (2006.01)

(52) U.S. Cl. ..... 139/292; 139/291 C; 139/298; 139/293

(58) Field of Classification Search ..... 139/292, 139/294–301, 291 R
See application file for complete search history.

(56) References Cited

U.S. PATENT DOCUMENTS 914,509 A * 3/1909 Prest ..... 139/294
1,621,177 A * 3/1927 Stimpson ..... 139/296
2,046,289 A * 6/1936 Douglas ..... 139/295
2,108,013 A * 2/1938 Fehr ..... 139/296
2,239,191 A * 4/1941 Chard ..... 139/295
2,434,820 A * 1/1948 Tifft ..... 139/296
2,666,457 A * 1/1954 Dewas ..... 139/295
2,972,361 A * 2/1961 Pfarrwaller et al. ..... 139/297
2,983,288 A * 5/1961 Metzler ..... 139/291 R
3,331,402 A * 7/1967 Kathriner et al. ..... 139/291 R (Continued)

FOREIGN PATENT DOCUMENTS

DE 195 38 137 C1 2/1997

(Continued)

OTHER PUBLICATIONS

Jim Gilchrist and Christine McIver, "Fechner's Paradox in Binocular Contrast Sensitivity", Vision Res., vol. 25, No. 4, pp. 609-613, 1985.

(Continued)

*Primary Examiner*—Bobby H Muromoto, Jr.
(74) *Attorney, Agent, or Firm*—Bacon & Thomas, PLLC

(57) ABSTRACT

Fabric support and a weaving machine using the support, in which the fabric support (1) includes several supporting elements (10, 11, 12, 13, 14, 15, 16, 17, 18, 19) which can be arranged next to one another and a profiled section (20, 30, 40, 50, 60) which is supported by the supporting elements (10, 11, 12, 13, 14, 15, 16, 17 18, 19) and includes a guide surface (22) for a fabric (3).

17 Claims, 8 Drawing Sheets

U.S. PATENT DOCUMENTS

| | | | | | |
|---|---|---|---|---|---|
| 3,346,017 | A | * | 10/1967 | Fend | 139/436 |
| 3,446,250 | A | * | 5/1969 | Pfarrwaller | 139/294 |
| 3,620,260 | A | * | 11/1971 | Bourlet et al. | 139/292 |
| 3,672,407 | A | * | 6/1972 | Luber | 139/295 |
| 3,771,573 | A | * | 11/1973 | Horn et al. | 139/294 |
| 3,885,600 | A | * | 5/1975 | Altmann | 139/292 |
| 4,245,675 | A | * | 1/1981 | Chiba et al. | 139/304 |
| 4,627,473 | A | * | 12/1986 | Ludwig | 139/294 |
| 4,997,010 | A | * | 3/1991 | Stacher | 139/192 |
| 5,101,864 | A | * | 4/1992 | Shaw | 139/307 |
| 6,910,508 | B2 | * | 6/2005 | Knecht | 139/291 C |
| 6,915,822 | B2 | * | 7/2005 | Krumm | 139/294 |
| 2003/0172984 | A1 | * | 9/2003 | Krumm | 139/294 |

FOREIGN PATENT DOCUMENTS

| | | | |
|---|---|---|---|
| EP | 0 292 429 | A | 11/1988 |
| EP | 0 368 799 | A | 5/1990 |
| EP | 1 033 427 | A | 9/2000 |

OTHER PUBLICATIONS

Charles M. Bourassa and Stanley J. Rule, "Binocular Brightness: A Suppression-Summation Trade Off", Canadian Journal of Experimental Psychology, vol. 48;3, pp. 418-433, 1994.

* cited by examiner

FABRIC SUPPORT FOR A WEAVING MACHINE

BACKGROUND

A. Field

The invention relates to a fabric support for a weaving machine.

B. Related Art

Weaving machines are known in which an elongate fabric support is fitted to the frame of the weaving machine. It is known, depending on the width of the fabric to be woven, to provide a fabric support of the appropriate length to the frame of the weaving machine. A fabric support of this type has the drawback that it is essentially only suitable to be used for weaving a fabric of a specific width and that usually the entire fabric support has to be replaced by a fabric support of a different length in order to weave a fabric of another width. In addition, it may be necessary to arrange certain modules within range of the fabric support in order to weave certain fabrics on a weaving machine. This may also require the replacement of the fabric support by a fabric support of a different length or of a different shape or the removal of the fabric support. Examples of such modules which may be mentioned are a weft monitor, a selvedge tuck-in device, a stretching blower, weft scissors or yet another module which can be fitted.

It is an object of the invention to provide a fabric support which can be adjusted to the width of the fabric to be woven in a simple manner and which can be adjusted according to the required modules for weaving a certain fabric in a simple manner.

SUMMARY OF THE DISCLOSURE

In order to achieve this object, a fabric support according to the invention comprises several supporting elements or sections which can be arranged next to one another and a profiled fabric guide element which is supported by the supporting elements and has a fabric support guide surface. By adjusting the number of supporting elements and by adjusting and/or replacing the profiled section, the fabric support according to the invention makes it possible to form a fabric support of a suitable length.

According to an embodiment, the fabric support comprises an elongate profiled section made in a single piece which extends at least across the width of the fabric to be woven. According to a variant, the fabric support comprises an elongate profiled section which is formed by several elongate profiled section parts which together extend at least across the width of the fabric to be woven.

According to a preferred embodiment the profiled section has a substantially U-shaped cross section.

The invention also relates to a weaving machine which uses a fabric support according to the invention.

DESCRIPTION OF THE DRAWINGS

Further features and advantages of the invention will become apparent from the following description of the exemplary embodiments illustrated in the drawings and from the subclaims, in which:

DETAILED DESCRIPTION OF PREFERRED EMBODIMENTS OF THE INVENTION

Figure 1:
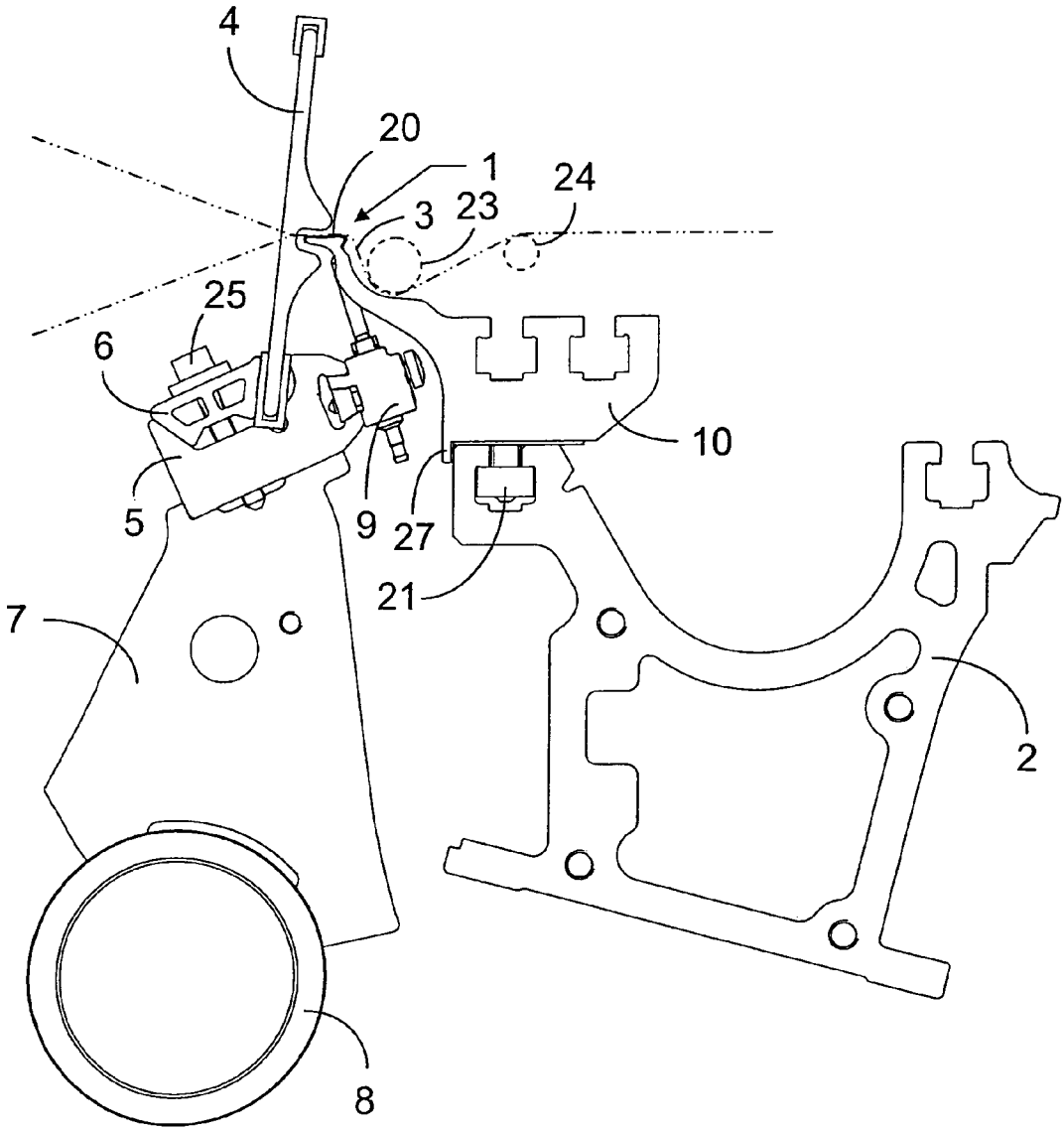
FIG. 1 diagrammatically shows a side view of a part of a weaving machine provided with a fabric support according to an invention.

FIG. 1 diagrammatically shows a fabric support 1 according to the invention. The fabric support 1 is fitted to the frame 2 of a weaving machine in order to support a fabric 3. The fabric support 1 extends at least across the width of the fabric 3, for example across a length in the order of magnitude of several meters. In addition, a reed 4, a reed beam 5, a clamping bar, 6, sley legs 7 and a sley shaft 8 are illustrated. The reed 4 is clamped into the reed beam 5 by means of bolts 25 and the clamping bar, 6. Diagrammatically illustrated temples 23 and guides 24 for the fabric 3 may be provided near the fabric support 1 in a known manner. Auxiliary blowers 9 are also provided on the reed beam 5 in a known manner. In addition, a supporting element 10 is illustrated which supports a profiled section 20 and is attached to the frame 2 by means of screw elements 21.

Figure 2:
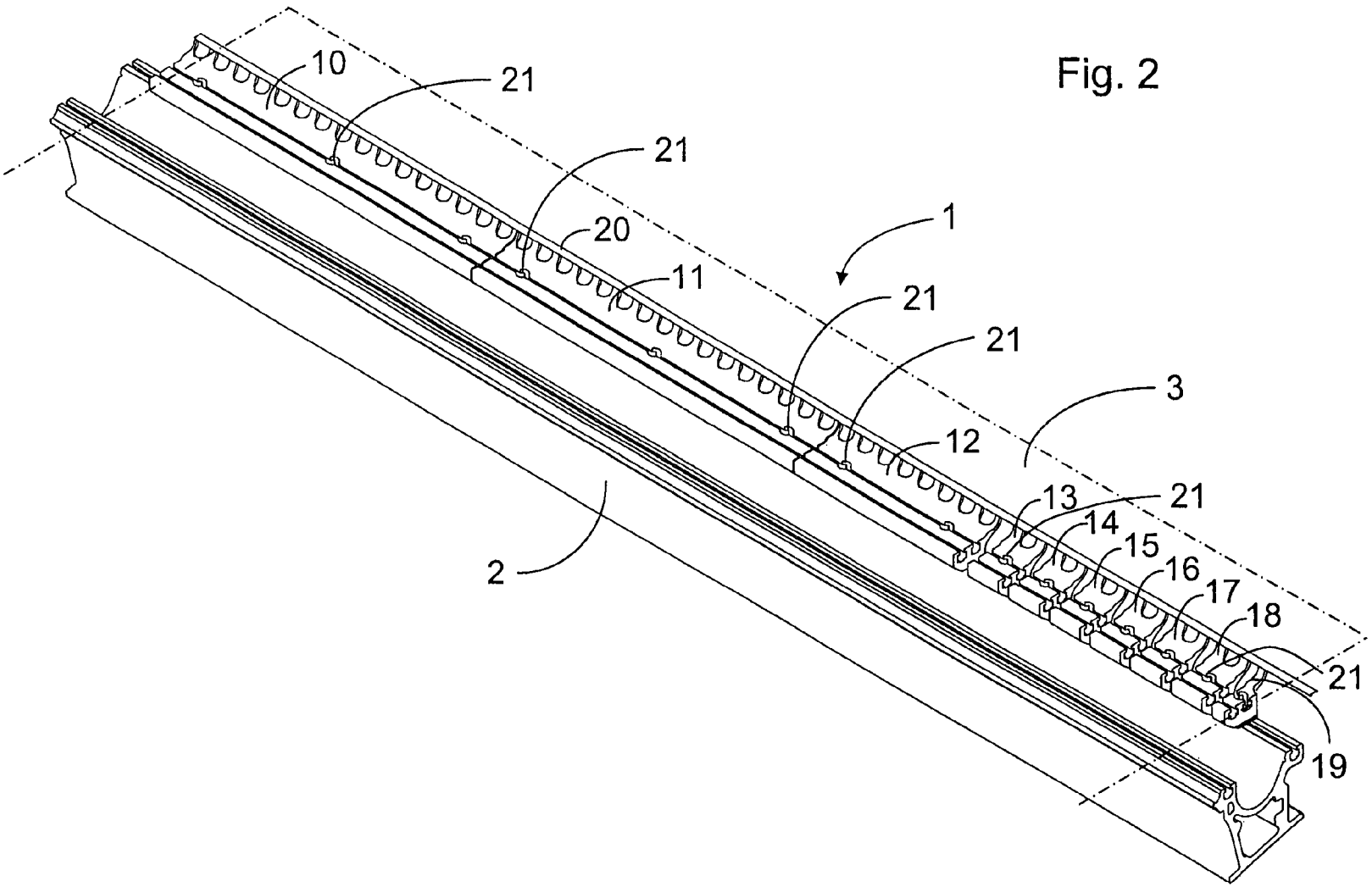
FIG. 2 shows a perspective view of a fabric support according to the invention.

FIG. 2 shows a perspective view of the fabric support 1 from FIG. 1. In this case, the elongate fabric support 1 comprises a number of supporting sections or elements 10 to 19 which are arranged next to one another and an elongate profiled fabric guide element or section 20 which is made in a single piece and supported by the supporting elements 10 to 19. The profiled section 20 extends across at least the width of the diagrammatically illustrated fabric 3 to be woven. Each of the supporting elements 10 to 19 is fixedly attached at its base to the frame 2 by means of screw elements 21, and includes a base section that is attached to the frame 2 and an upwardly extending upper section terminating at an upper distal end. The base and upwardly extending section are integrally formed as a single piece as illustrated in the drawings, in particular FIG. 3.

Figure 3:
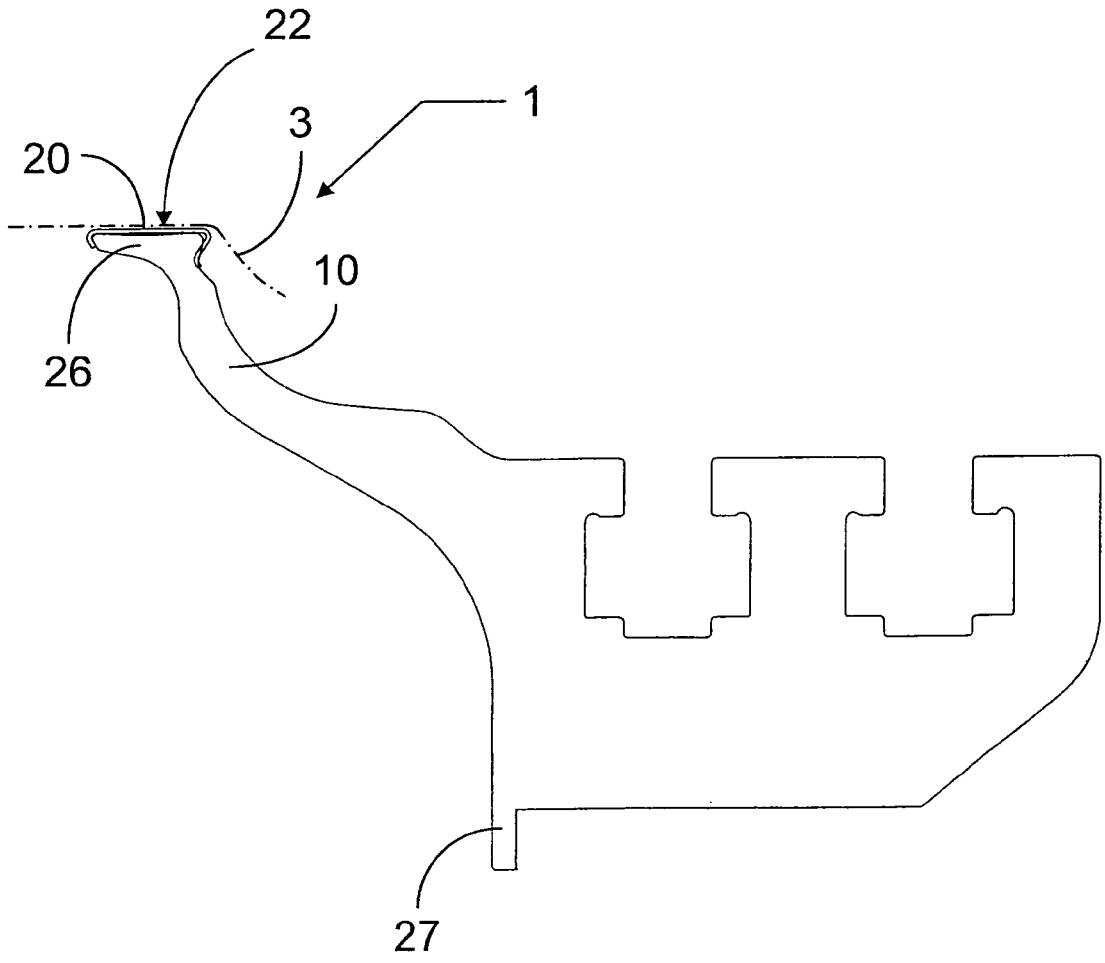
FIG. 3 shows a side view of the fabric support from FIG. 1.

As is illustrated in an enlarged scale in FIG. 3, the profiled section 20 comprises an upper fabric support or guide surface 22 in order to support and guide a fabric 3. The profiled section 20 is arranged on the upper distal ends of the upwardly extending portions of the supporting elements 10 to 19 by clamping, gluing, snap-fitting and/or attaching the profiled section 20 to the supporting elements 10 to 19. The profiled section 20 in this case has a virtually U-shaped cross section. The cross section of the profiled section 20 with a slightly closed U-shape, as illustrated in FIG. 3, allows the profiled section 20 to be snapped onto the supporting elements.

Figure 4:
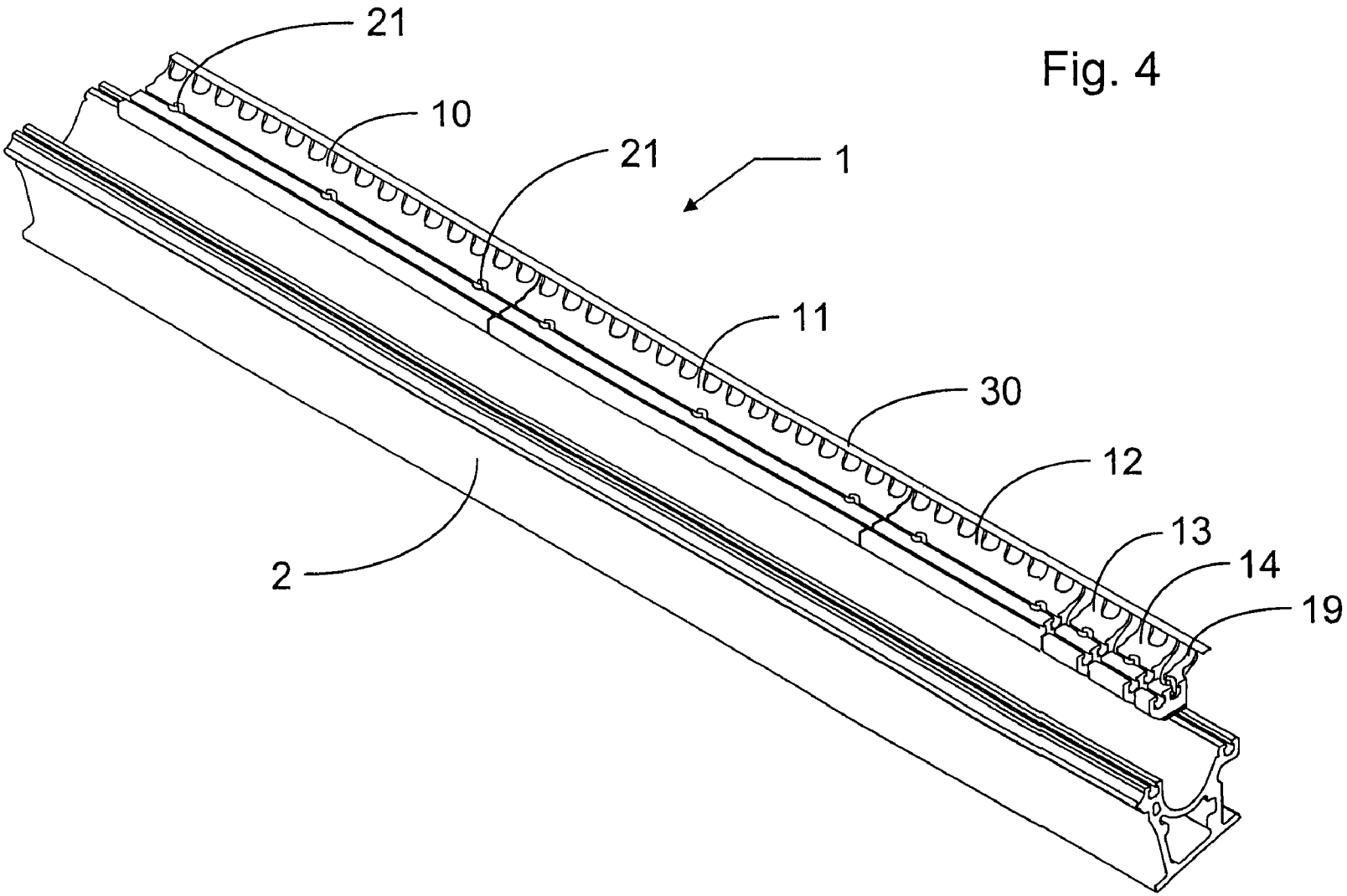
FIG. 4 shows a perspective view of a fabric support from FIG. 2 having a different length.

The embodiment shown in FIG. 4 only comprises the supporting elements 10, 11, 12, 13, 14 and 19 and a profiled section 30 which has a smaller length than the profiled section 20 in FIG. 2. This arrangement can be achieved by removing the supporting elements 15, 16, 17 and 18 from the embodiment from FIG. 2 and by replacing the profiled section 20 by a profiled section 30 of a different length A fabric support 1 of this type is used, for example, in order to support a fabric which is less wide than the fabric 3 from FIG. 2.

Figure 5:
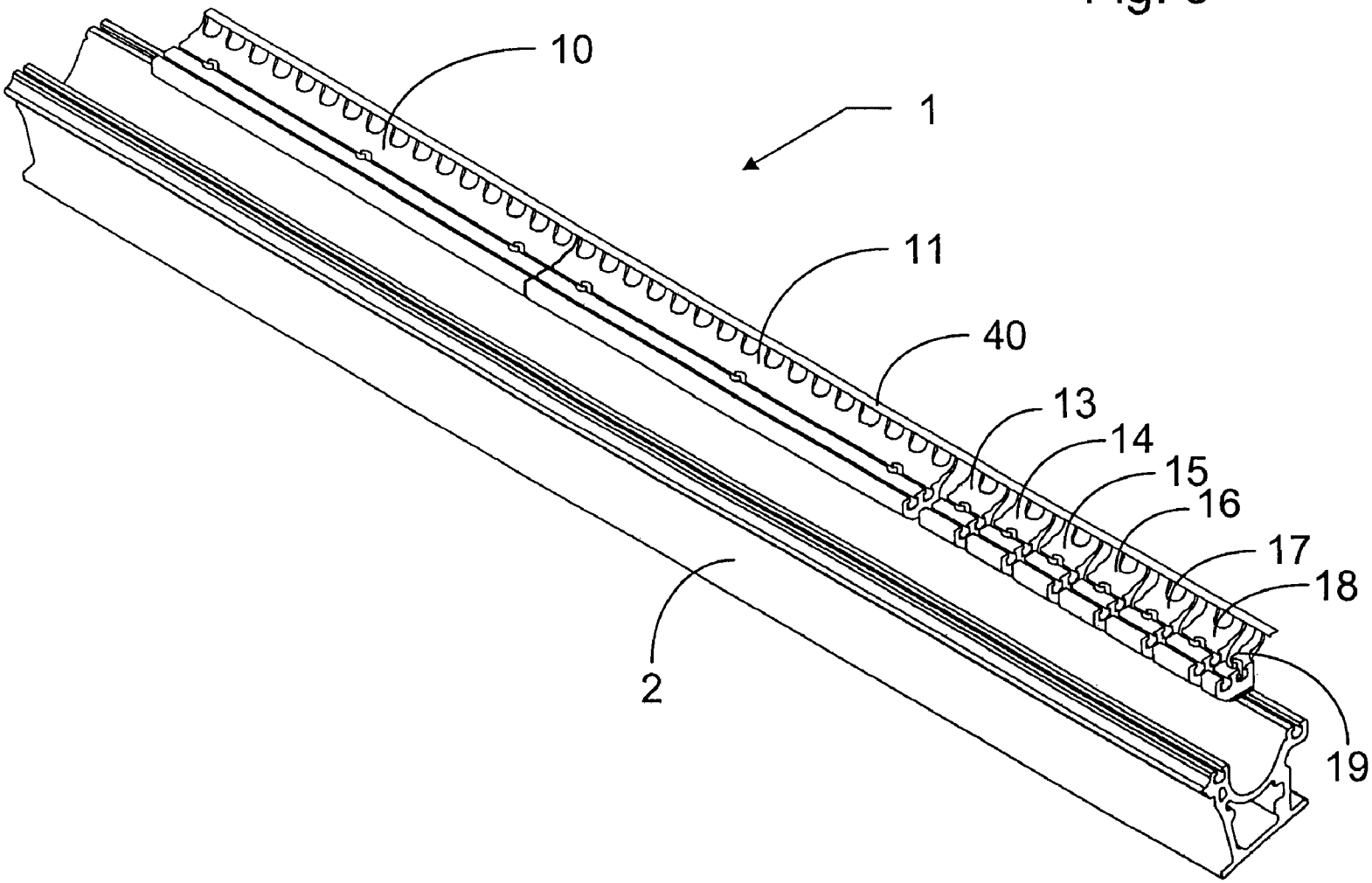
FIG. 5 shows a perspective view of a fabric support from FIG. 2 having another different length.
Figure 6:
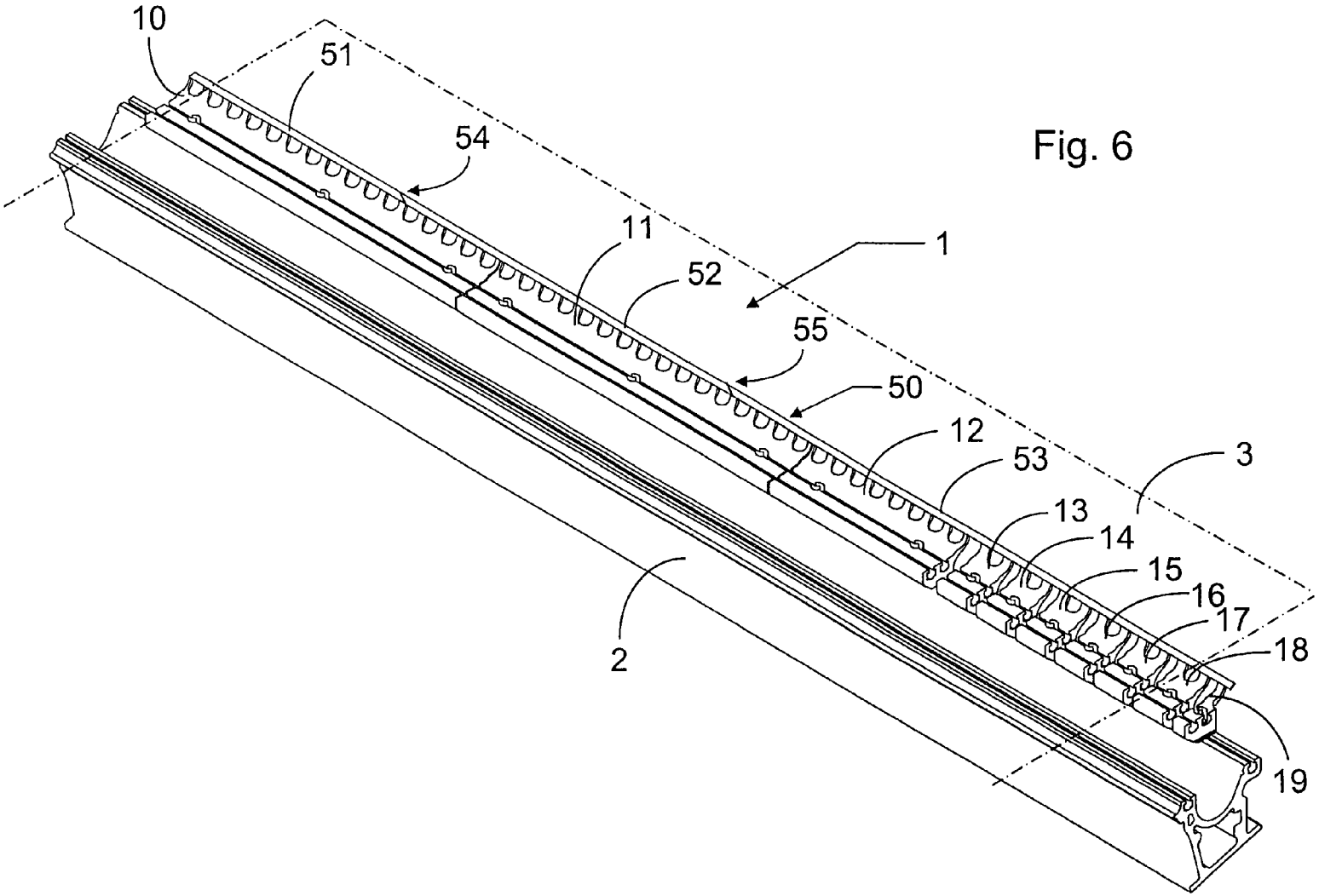
FIG. 6 shows a variant of FIG. 2.

FIG. 5 shows another variant in which only the supporting elements 10, 11, 13, 14, 15, 16, 17, 18 and 19 are provided, the supporting elements 10 and 11 having been moved sideways compared to the embodiment from FIG. 2. In this case, a profiled section 40 of suitable length is provided. Of course, other arrangements of supporting elements and profiled sections are likewise possible. It is an advantage of a fabric support 1 according to the invention that the positioning of the edges of the fabric to be woven can be selected and/or adjusted both on the left-hand side and on the right-hand side of the weaving machine. Zone Name: b5,AMD FIG. 6 shows a variant in which an elongate profiled section 50 is assembled from a number of elongate profiled section parts 51, 52 and 53 which are provided on associated supporting elements in line with one another. These profiled section parts 51, 52 and 53 together form a single entity which makes it possible to support a fabric across its width. At the sides 54, the ends of the profiled section parts 51 and 52 are at an angle to the longitudinal direction of the composite profiled section 50, so that the fabric is always supported by at least one of these profiled section parts 51, 52 when the angles are beyond 90° and are complementary, adding up to 180° (a straight line as show).

As can be seen, according to one possibility, the supporting elements 10 to 19 can be arranged virtually adjoining one another or with a certain distance between one another. As the profiled section 20, 30, 40, 50 supports the fabric virtually without interruption, it is not necessary for the supporting elements to be arranged adjoining one another. In this case, the various supporting elements can be arranged with a distance between one another. Normally, the profiled section is of sufficient rigidity to bridge this relatively limited intermediate distance. A possible intermediate distance is in the order of magnitude of ten millimeters. A U-shaped steel profiled section having a thickness in the order of magnitude of approximately half a millimeter is more than sufficiently rigid to bridge such a distance.

Figure 7:
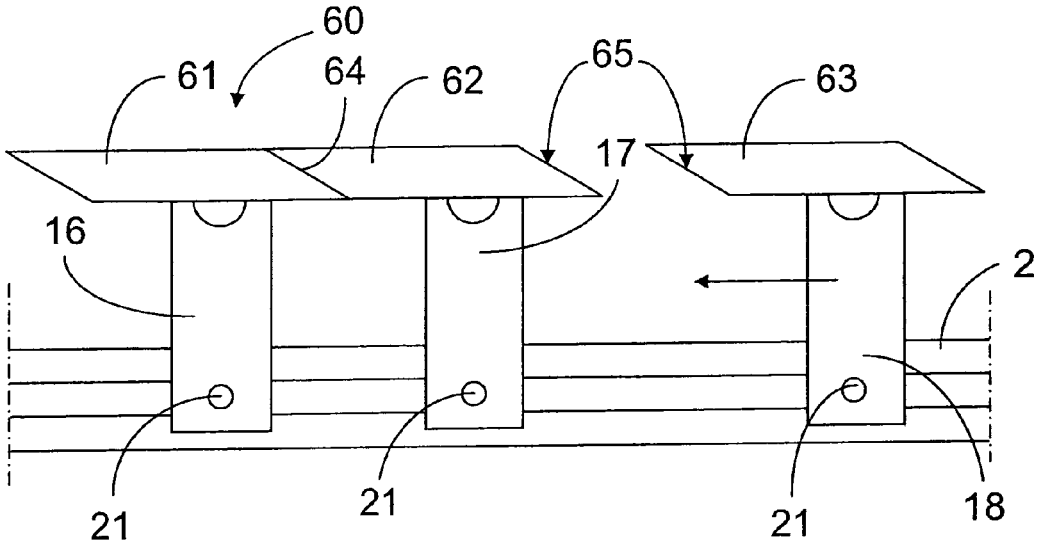
FIG. 7 shows a top view of a variant in the non-fitted state.
Figure 8:
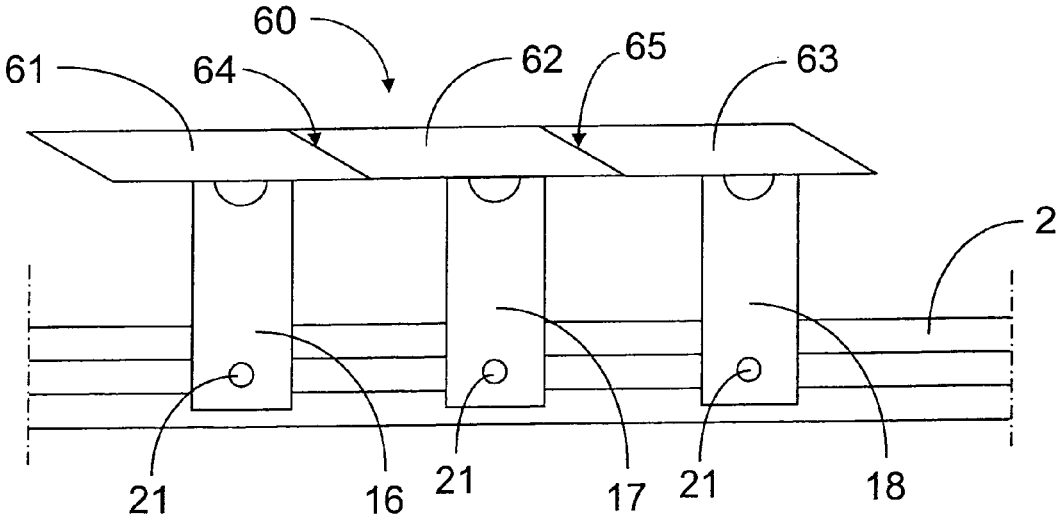
FIG. 8 shows the variant from FIG. 7 in the fitted state.

FIG. 7 shows an embodiment in which some supporting elements 16, 17, 18 are provided with an associated profiled section part 61, 62, 63, respectively. The supporting elements 16, 17 are arranged next to one another and have been pushed towards one another in such a manner that the profiled section parts 61, 62 touch one another at the respective sides 64. In this position, the respective sides 65 of the supporting elements 17 and 18 are arranged at a distance from one another. In order to arrive at the position shown in FIG. 8, the supporting element 18 is moved towards the supporting element 17 until the profiled section parts 62 and 63 touch one another. In this case, the profiled section parts 61, 62, 63 together form a continuous profiled section 60. In this case, the supporting elements 16, 17 and 18, together with their respective profiled section parts 61, 62 and 63, can be fitted to or removed from the frame 2 in a simple manner. It is clear that it is possible with this embodiment to connect the profiled section parts 61, 62 and 63 permanently, for example by gluing or soldering, to an associated supporting element 16, 17 or 18. This makes it possible, inter alia, to attach the profiled section parts 61, 62 and 63 in such a manner that the desired intermediate distance between the associated supporting elements 16, 17 and 18 is ensured. This intermediate distance may, for example, be sufficiently large to allow a module to be attached to the weaving machine between the supporting elements, such as for example an auxiliary blower, a stretching blower, a weft monitor or even weft scissors or a selvedge tuck-in device.

Figure 9:
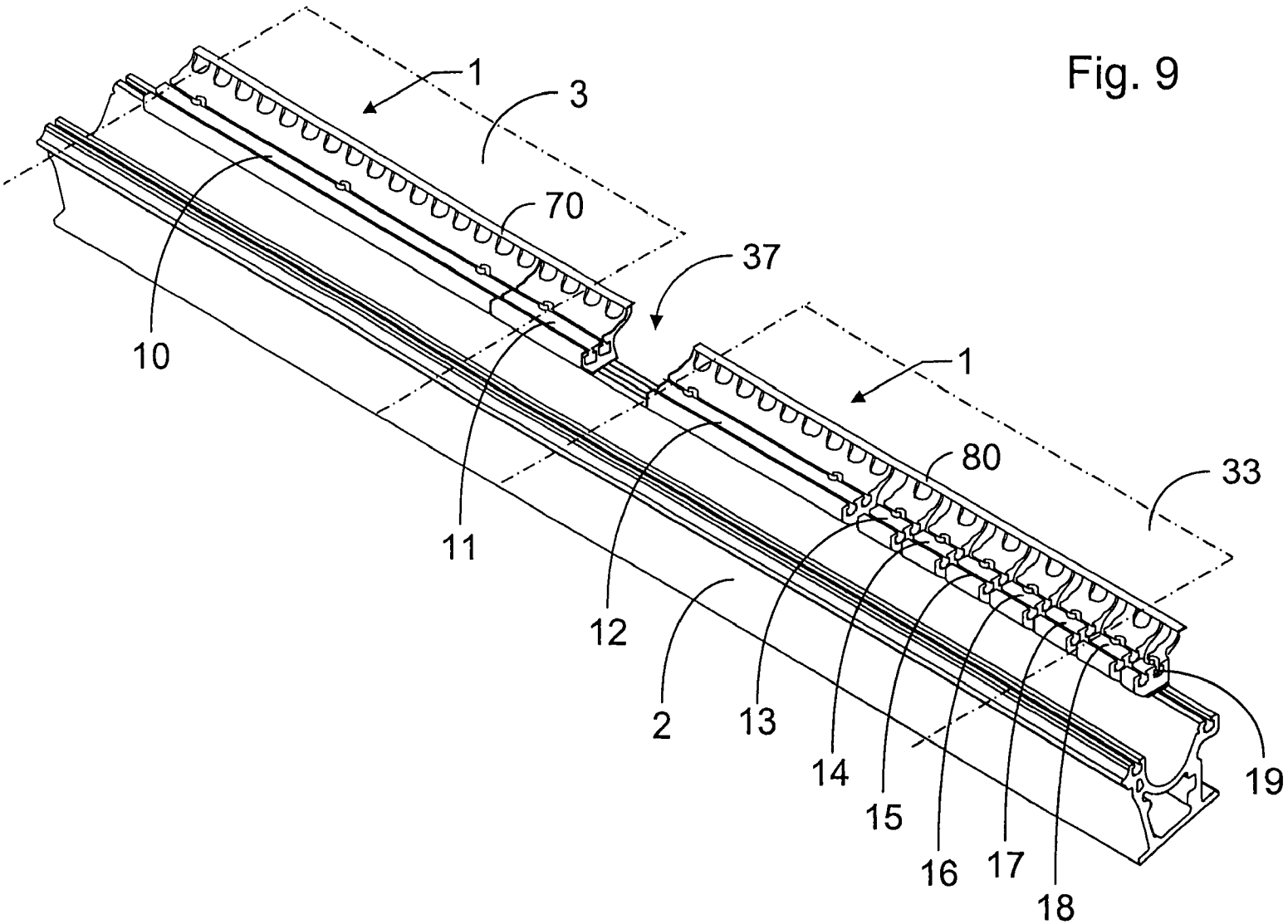
FIG. 9 shows another variant of FIG. 2.

In the embodiment of FIG. 9, two fabric supports 1 are arranged next to one another at a certain distance 37. The distance 37 may in this case, for example, be used in order to provide a selvedge tuck-in device, for example a mechanical and/or pneumatic selvedge tuck-in device, or any other module which can be fitted. In the exemplary embodiment of FIG. 9, a fabric support 1 is formed by supporting elements 10 and 11, to which a profiled section 70 is attached, and a fabric support 1 is formed by supporting elements 12 to 19, to which a profiled section 80 is attached. In this exemplary embodiment, the profiled sections 70 and 80 extend respectively across the width of a fabric 3 and 33. The fabrics 3 and 33 are woven next to one another on the same weaving machine. In this case, the distance 37 allows the use of a selvedge tuck-in device, in particular a so-called middle selvedge tuck-in device, which can interact with both fabrics 3 and 33 and which can work in combination with a reed which extends substantially across the width of the weaving machine, more particularly across both fabrics 3 and 33.

It is clear that a fabric support 1 according to the invention can also be formed by means of other combinations than those combinations illustrated and composed of several supporting elements and a profiled section optionally comprising one or more profiled section parts. According to the invention, the number of supporting elements and/or the number of profiled section parts can be chosen depending on the fabric to be woven. The fabric support 1 according to the invention may comprise a lip 26, which gets as far as into the guide duct of the reed 4 when a weft thread is beaten by the reed 4, but, according to another possibility, may, for example, also be designed without a lip.

As can be seen in FIGS. 1 and 3, the supporting element 10 has a collar or lip 27 which makes it possible to attach the supporting element 10 accurately on the frame 2. Providing the supporting element 10 to 19, more particularly the supporting elements 13 to 19 which are only attached using one single pair of screw elements 21, with a collar 27 offers the advantage that the supporting elements 10 to 19 can be attached so as to be accurately aligned with respect to the frame 2. The collar 27 faces towards the reed 4 of the beat-up device of the weaving machines, as shown.)

In the embodiment of FIG. 2, the supporting elements 10 and 11 have a length of, for example, '600' millimeters, the supporting element 12 has a length of '300' millimeters, the supporting elements 13 to 18 have a length of '60' millimeters and the supporting element 19 has a length of '12' millimeters.

The fabric support according to the invention can, of course, be used with various kinds of weaving machines, such as with an air weaving machine, a gripper weaving machine or yet another type of weaving machine.

Obviously, the weaving machine and the fabric support according to the invention are not limited to the embodiments described by way of example and illustrated in the figures, but may, within the terms of the claims, be designed according to different variants and in accordance with different combinations of the abovementioned embodiments.

The invention claimed is:

1. Fabric support for supporting a woven fabric on a weaving machine having a frame and a beat-up reed, comprising:

at least two support sections, the support sections each including a lower base section adapted to be attached to a weaving machine frame adjacent the fabric side of the beat-up reed of such weaving machine, and an upwardly extending upper section extending from the base section and terminating at a distal upper end;

an elongate profiled fabric guide element having an upper fabric support surface and an opposite lower side, said guide element being removably connectable along at least a part of its lower side to each upwardly extending support section distal upper end so as to span the upper ends of said support sections, with said fabric support surface facing upwardly away from the distal upper ends to thereby present a continuous uninterrupted support surface for a woven fabric; and said fabric guide element extending uninterrupted over a length at least corresponding to a width of a fabric to be supported by the fabric support.

2. The fabric support according to claim 1, said upper section and base section of each support section formed in one integral piece.

3. The fabric support according to claim 1, the base of each support section including a collar along a side thereof adapted to align the base with a frame of a weaving machine.

4. The fabric support according to claim 1, wherein the profiled guide element includes downwardly extending lips, and the distal upper ends of the upper sections of the support sections are configured and adapted to receive the lips in a snap-fit relationship onto the upper ends to enable the guide elements to be connected to the support sections.

5. Fabric support for supporting a woven fabric on a weaving machine having a frame and a beat-up reed, comprising:

at least two support sections, the support sections each including a lower base section adapted to be attached to a weaving machine frame adjacent the fabric side of the beat-up reed of such weaving machine, and an upwardly extending upper section extending from the base section and terminating at a distal upper end;

at least two elongate profiled fabric guide elements each having an upper fabric support surface and an opposite lower side, each of said guide elements being removably connectable along at least a part of its lower side to a distal upper end of at least one support section, with each fabric support surface facing upwardly away from a respective support section distal upper end to thereby present a support surface for a woven fabric.

6. The fabric support according to claim 5, wherein said fabric guide elements each terminate at at least one end that is angled other than 90 degrees relative to the lengthwise direction of the guide element to enable the guide elements to present continuous support for a woven fabric supported by the guide elements when the at least two guide elements are located in alignment with each other with their respective angled ends adjacent each other, and wherein the angles of said adjacent ends are complementary to each other so the sum of the angles equals 180 degrees.

7. The fabric support according to claim 5, the base of each support section including a collar along a side thereof adapted to align the base with a frame of a weaving machine.

8. The fabric support according to claim 5, wherein each profiled guide element includes downwardly extending lips, and the distal upper ends of the upper sections of the support sections are configured and adapted to receive the lips in a snap-fit relationship onto the upper ends to enable connection of the guide elements to the support sections.

9. The fabric support according to claim 5, wherein at least one guide element spans and is removably connectable at its lower side to distal upper ends of at least two support sections.

10. Weaving machine having a frame, a beat-up reed, and a fabric support for supporting woven fabric beyond the reed, said fabric support comprising:

at least two support sections, the support sections each including a lower base section adapted to be adjustably and removably attached to the weaving machine frame adjacent the fabric side of the beat-up reed of the weaving machine, and an upwardly extending upper section extending from the base section and terminating at a distal upper end;

each base section connected to the frame in an adjustable manner enabling the base sections to be secured to the frame at various locations along the frame relative to the width of a fabric to be woven in alignment with each other;

an elongate profiled fabric guide element having an upper fabric support surface and an opposite lower side, said guide element being removably connectable along at least a part of its lower side to each upwardly extending support distal upper end so as to span the upper ends of said support sections, with said fabric support surface facing upwardly away from the distal upper ends to thereby present a continuous uninterrupted support surface for a woven fabric; and said fabric guide element extending uninterrupted over a length at least corresponding to a width of a fabric to be supported by the fabric support.

11. The weaving machine according to claim 10, said frame extending widthwise relative to a fabric to be woven on the weaving machine and having an edge extending along the frame facing towards the reed; the base of each support section including a collar along a side thereof adapted to engage said edge of the frame when the base is attached to the frame to enable alignment of the base with the frame of the weaving machine.

12. The weaving machine according to claim 10, wherein the profiled guide element includes downwardly extending lips, and the distal upper ends of the upper sections of the support sections are configured and adapted to receive the lips in a snap-fit relationship onto the distal upper ends to enable connection of the guide elements to the support sections.

13. Weaving machine having a frame, a beat-up reed, and a fabric support for supporting woven fabric beyond the reed, said fabric support comprising:

at least two support sections, the support sections each including a lower base section adapted to be adjustably and removably attached to the weaving machine frame adjacent the fabric side of the beat-up reed of the weaving machine, and an upwardly extending upper section extending from the base section and terminating at a distal upper end;

each base section connected to the frame in an adjustable manner enabling the base sections to be removably and adjustably secured to the frame in alignment with each other at various locations along the frame relative to the width of fabric to be woven;

at least two elongate profiled fabric guide elements each having an upper fabric support surface and an opposite lower side, each guide element being removably connected along at least a part of a lower side thereof to at least one upper section distal upper end, with each fabric support surface facing upwardly away from a respective support upper section distal upper end to thereby present a support surface for a woven fabric over at least a portion of the fabric width.

14. The weaving machine according to claim 13, wherein said fabric guide elements each terminate at at least one end that is angled other than 90 degrees relative to the lengthwise direction of the guide element to enable the guide elements to present continuous support for a woven fabric supported by the guide elements when the at least two guide elements are located in alignment with each other with their respective angled ends adjacent each other, and wherein the angles of said adjacent ends are complementary to each other so the sum of the angles equals 180 degrees.

15. The weaving machine according to claim 13, said frame extending widthwise relative to a fabric to be woven on the weaving machine and having an edge extending along the frame facing towards the reed; the base of each support section including a collar along a side thereof adapted to engage said edge of the frame when the base is attached to the frame to enable alignment of the base with the frame of the weaving machine.

16. The weaving machine according to claim 13, wherein the profiled guide elements include downwardly extending lips, and the distal upper ends of the upper sections of the support sections are configured and adapted to receive the lips in a snap-fit relationship onto the distal upper ends to connect the guide elements to the support sections.

17. Weaving machine according to claim 13, wherein at least one guide element spans and is removably connected at its lower side to distal upper ends of at least two support sections.

* * * * *